United States Patent [19]

Ng

[11] Patent Number: 4,994,656

[45] Date of Patent: Feb. 19, 1991

[54] LOGIC DESIGN SLIDE RULE

[76] Inventor: Wang C. Ng, 6545 Calvine Rd., Sacramento, Calif. 95823

[21] Appl. No.: 270,079

[22] Filed: Nov. 14, 1988

[51] Int. Cl.[5] ..... G06C 27/00

[52] U.S. Cl. ..... 235/69; 235/70 R; 235/85 R

[58] Field of Search ..... 235/69, 70 R, 85 R, 235/70 A, 70 B, 70 C, 89 R; 116/321, 323, DIG. 37, 47

[56] References Cited

U.S. PATENT DOCUMENTS

| | | | |
|---|---|---|---|
| 1,892,634 | 12/1932 | Rubinsky | 235/69 |
| 1,961,053 | 5/1934 | Kubler | 235/69 |
| 2,530,047 | 11/1950 | Dewar | 235/70 B |
| 2,530,423 | 11/1950 | Carson | 434/195 |
| 2,585,595 | 2/1952 | Spencer | 235/70 R |
| 2,610,792 | 9/1952 | Kaufman | 235/69 |
| 2,657,610 | 11/1953 | Carran, Jr. | 84/473 |
| 2,832,539 | 4/1958 | Blakeley et al. | 235/70 R |
| 3,779,454 | 12/1973 | Koren | 235/70 A |
| 4,056,359 | 11/1977 | Janin | 235/69 X |
| 4,425,499 | 1/1984 | Newton | 235/70 R |

*Primary Examiner*—Benjamin R. Fuller

*Attorney, Agent, or Firm*—Douglas E. White

[57] ABSTRACT

A logic design slide rule comprises, in a preferred embodiment, front and rear cover plates coupled together; interior slide channels formed between the covers; and a plurality of slides disposed between the covers and able to move horizontally from left to right within the channels. The slides may be moved to display indicia on beams for observation through a single column of truth-table windows and to display corresponding indicia printed on interior slide plates for observation through an array or grid of K-map windows, which column and grid of windows are located in the front cover of the slide rule. Indicia are also displayed through a set of output variable slots, preferably in the rear cover. Operation of the preferred slide rule will aid the designer to obtain a minimum set of combinational logic functions for up to four input variable from a given truth-table.

13 Claims, 4 Drawing Sheets

LOGIC DESIGN SLIDE RULE

FIELD OF THE INVENTION

This invention relates to a device for use as an aid in the design of combinational logic circuits, more particularly to a mechanical slide rule.

BACKGROUND OF THE INVENTION

Prior developments in this field will be generally illustrated by reference to the following patents:

| Pat. No. | Patentee | Issue Date |
|---|---|---|
| 2,530,423 | C. Carson | 11/21/50 |
| 2,657,610 | W.E. Carran, Jr. | 11/03/53 |
| 4,425,499 | R.A. Newton | 01/10/84 |
| 3,779,454 | J. Koren | 12/18/73 |
| 2,832,539 | J.D. Blakeley et al. | 04/29/58 |
| 2,585,595 | N.S. Spencer | 02/12/52 |
| 2,530,047 | N.F. Dewar | 11/14/50 |

For large-scale projects, computers may be used to design combinational logic circuits. It is simply not worth the effort, however, to use a computer to design a small-scale digital circuit—so the traditional method, namely, pencil and paper, is still used. Therefore, there is a need for a small, inexpensive mechanical aid for designing digital circuits which provides easier, faster and less error-prone solutions than does manual computation, much in the way logarithmic slide rules were used in the past to solve arithmetic problems.

While the patents listed above teach slide rule and slide rule-like mechanical devices directed to a number of problems, none attempt to address logic circuit design. Furthermore, there are a number of physical differences between the device of the present invention and those shown in the cited art. C. Carson's calculating board, U.S. Pat. No. 2,530,423, shows multiple slides and multiple viewing windows. Parts 39 and 49 of Carson somewhat resemble the display plates taught infra. However, parts 39 and 49 of Carson are located externally and do not contain indicia.

SUMMARY OF THE INVENTION

The present invention is a logic design slide rule which comprises, in a preferred embodiment, front and rear cover plates coupled together; interior slide channels formed between the covers; and a plurality of slides disposed between the covers and able to move horizontally from left to right within the channels. The slides may be moved to display indicia on beams for observation through a single column of truth-table windows and to display corresponding indicia printed on interior slide plates for observation through an array or grid of K-map (Karnaugh map) windows, which column and grid of windows are located in the front cover of the slide rule. Indicia are also displayed through a set of output variable slots, preferably in the rear cover. Operation of the preferred slide rule will aid the designer to obtain a minimum set of combinational logic functions for up to four input variables from a given truth-table.

FEATURES AND ADVANTAGES

An object of this invention is to provide an easy, quick and almost error-free aid for designing combinational logic circuits which may be made small enough to be carried by a circuit designer in a pocket or stored in a desk drawer or briefcase.

A further object is to provide such a device which may be constructed out of inexpensive materials, such as plastic or cardboard.

Yet another object is to provide a mechanical device which does not require electrical power and may be substituted for computer equipment in small-scale digital circuit problems.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "lefwardly" and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 1:
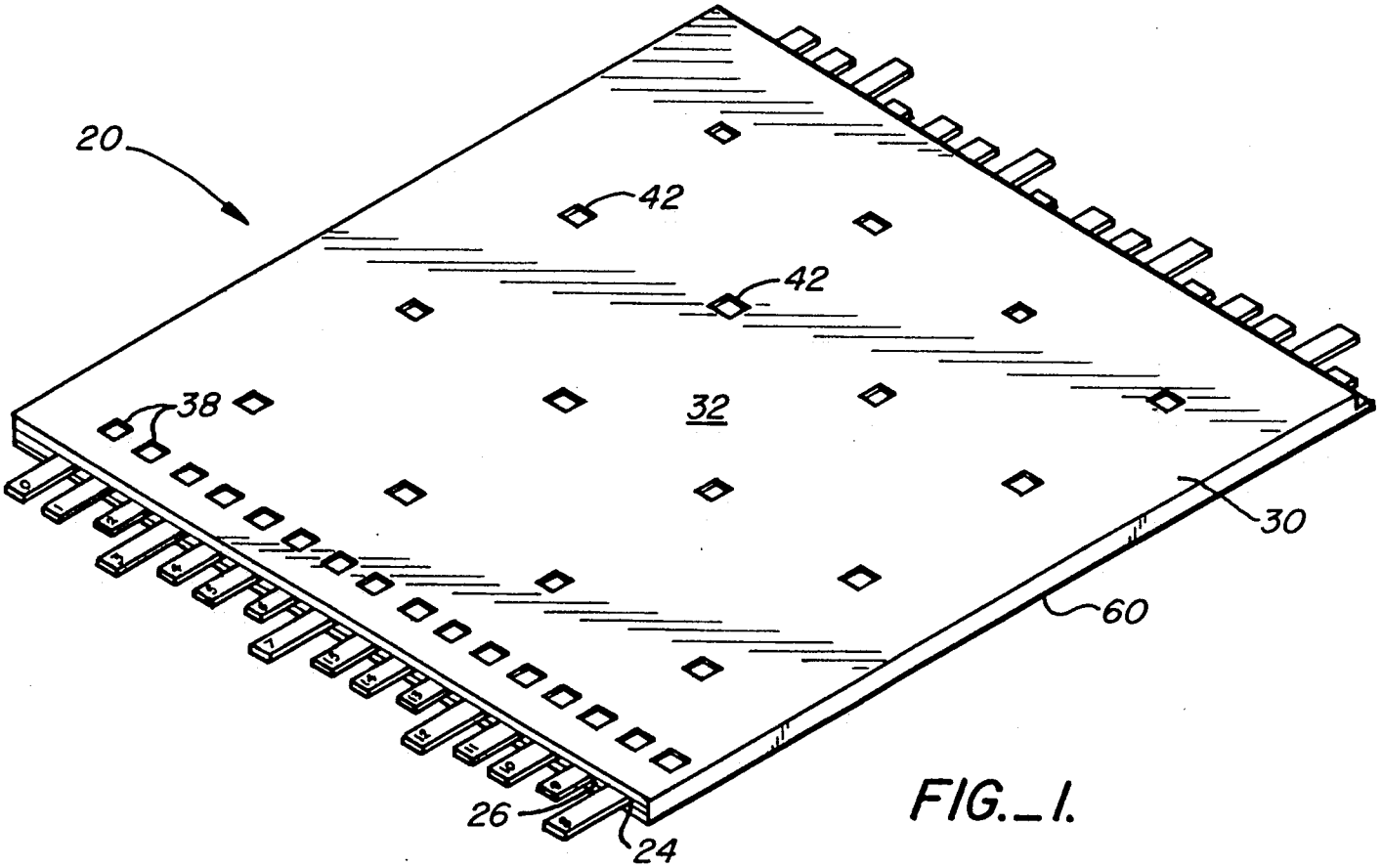
FIG. 1 is a perspective view of the assembled slide rule of my invention.

20 slide rule
24 slide channels
26 posts
30 front cover plate
32 front surface of 30
36 column of 38
38 truth table apertures
40 grid of 42
42 K-map apertures
60 rear cover plate
62 front surface of 60
64 rear surface of 60
66 set of 68
68 output variable apertures
80 slides
81 pull tabs
82 guide beams
83 front side of 82
84 lower spacing tip
85 rear side of 82

86 front beam indicia
87 rear beam indicia
88 display plate
89 first position of 88
90 second position of 88
91 third position of 88
92 fourth position of 88
94 plate indicia

DESCRIPTION OF A PREFERRED EMBODIMENT

Figure 2:
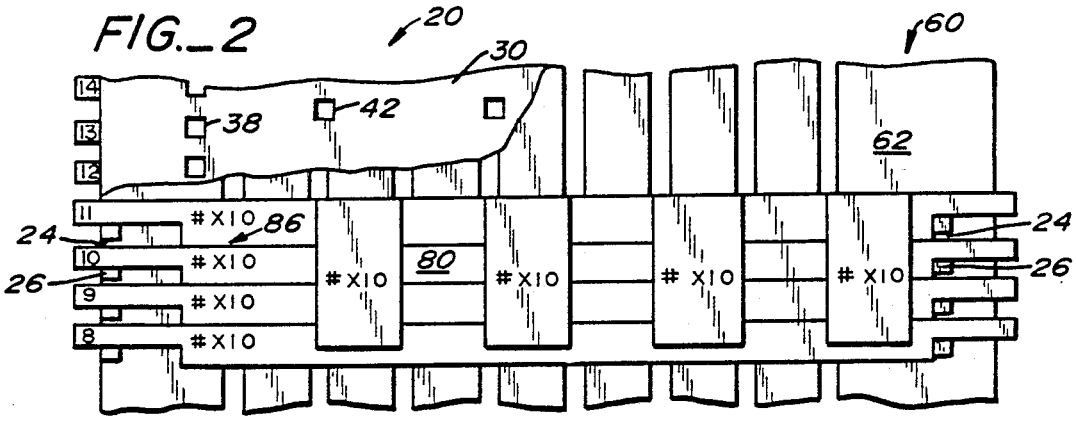
FIG. 2 is a broken front view of the slide rule of FIG. 1.

Referring to FIGS. 1 and 2, there is illustrate therein a logic design slide rule 20 which comprises a front cover plate 30; interior aligned and parallel slide channels 24; a plurality of slides 80 engaged within the channels and able to move horizontally from left to right within the channels; and a rear cover plate 60.

The front cover 30 has a single vertical column 36 of truth-table window apertures 38 and a square grid 40 of K-map window apertures 42. The rear cover 60 has a set of full height vertical output variable slot apertures 68.

Each slide 80 comprises a guide beam 82 having a pull tab 81 at each end. A lower spacing lip 84 depends from the bottom of a beam 82 which slidably engages with the top of an adjacent beam 82 to maintain spacing and smooth operation. Since the height of lip 84 and beam 82 combined is larger than that of the channels 24 (which channels are formed between posts 26 and only extend a small way inwardly from the left and right sides of the slide rule 20), the lip 82 also acts as a stop for restraining the slide 80 from moving beyond its authorized horizontal operation conditions.

Figure 3:
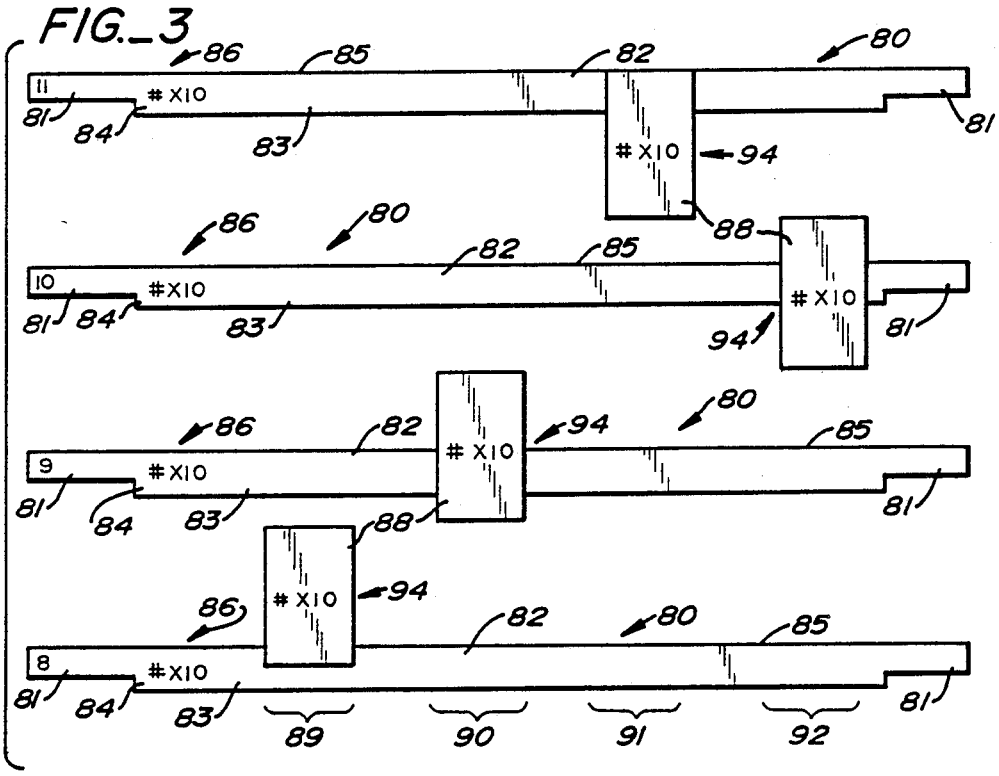
FIG. 3 is an exploded front view of four representative slides of the slide rule.
Figure 4:
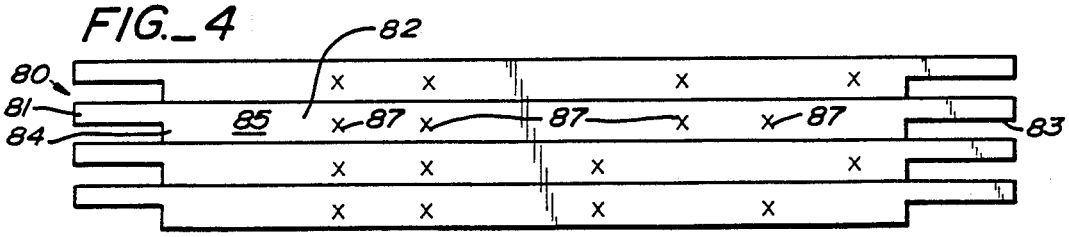
FIG. 4 is an assembled rear view of the four slides of FIG. 3.

With further reference to FIGS. 3 and 4, a display plate 88 is attached to the front of each beam 82 so that, in operation within the channels, all display plates 88 are superimposed in front of all beams 82 and may freely move laterally from one position to another as the associated slide 80 moves left to right and back again. Plates 88 thus are sandwiched between slides 80 and the front cover 30. Portions of the plates which bear indicia are visible through the apertures 38, 42, as discussed below.

It is to be noted that similar reference numerals refer to similar parts throughout the drawing. Each left pull tab 81 has a unique decimal number printed on it and while all tabs are herein referred to simply as tabs 81, reference may be made to tab 1 or slide 1 to indicate the tabbed slide bearing the number 1 on its left end, and so on. Furthermore, for clarity and ease of illustration, only slide 10 bears a full set of reference numerals in FIGS. 2 and 4—slides 8, 9 and 11 all having similar parts.

Front Beam indicia or marks 86 are located on the front side 83 of a beam 82 in positions that reveal one front beam mark 86 through a corresponding front cover truth-table window 38 in each operating position of a slide 80. The width of lip 84 is such that in the preferred embodiment only four indicia displaying positions are possible for each slide 80 before alternately abutting its depending lip 84 against the opposing two vertical rows of posts 26 which define channels 24.

As noted, decimal numbers are printed on the left pull tab end 81 of each beam 82. The binary numbers corresponding thereto are printed on the front surface 32 of cover 30 to the left of the truth-table window column 38. A corresponding array of decimal/binary numbers appears on the K-map grid 40 such that each numbered tab affects in operation an equivalently numbered truth-table window 38 and an identically numbered K-map window 42.

Display plate indicia or marks 94 are located on the front of the display plate 88 in positions that reveal one display plate mark through a corresponding K-map window 42 in each operating position of the slide 80. The front beam indicia 86 are identical to and in the same horizontal order as the display plate indicia 94.

The positioning of display plates 88 will be described with reference to slides 8, 9, 10 and 11. Each beam 82 may be visualized as being generally separated into four display plate positions, numbered 89, 90, 91 and 92 proceeding from left to right in FIG. 3. Slide 8 has a display plate 88 superimposed on its front side 83 in the first position 89; the display plate of slide 9 is in the second position 90; the display plate of slide 10 is the fourth position 92; and the display plate of slide 11 is in the third position 93. The plates are all alike in having indicia 94 printed horizontally across their vertical midpoints.

When assembled as shown in FIG. 2, each of four groups of four slides, e.g. slides 8–11, reveals four rows of plate marks 94 aligned end to end in a single row. To accomplish this row alignment, the plates 88 of each group are offset vertically up or down varying degrees within their positions 89–92.

At the same time, four rows of identical front beam marks 86 are stacked vertically for each group sixteen rows in all. This feature allows the same mark to be displayed in the truth-table window 38 opposite a pull tab 81 as is found in the K-map window bearing the same number as the tab. This facilitates the solution of design problems as discussed below. The arrangement (not shown) of the display plates on the remaining 12 slides corresponds to that discussed with the following plate positions (proceeding downwardly): slide 0—first position; slide 1—second position; slide 2—fourth position; slide 3—third position; slide 4—fourth position; slide 5—second position; slide 6—fourth position; slide 7—third position; slide 15—third position; slide 14—fourth position; slide 13—second position; and slide 12—first position. The plates 88 on slides 0–3 align their plate indicia 94 in a single horizontal row underlying the top row of K-map apertures so as to be alternately visible therefrom as the slides are moved; the plates on sides 4–7 align their plate indicia under the second row; and the plate indicia of slides 15–12 align under the third row.

Turning to FIG. 4, the rear sides 85 of the beams contain printed rear beam indicia or marks 87 which may be viewed through set 66 of corresponding rear cover 60 vertical output variable slot apertures 68. In all but one position of any one slide 80 there are no rear beam indicia 87 visible through slots 68; in the one position, all rear beam indicia 87 of that slide arm visible through appropriate slits 68.

Printed on the rear surface 64 of rear cover 60 at the tops of slots 68, for the identification of solution indicia 87 visible therein, are the variation labels (reading left to right): $x_3$, $\bar{x}_3$, $x_2$, $\bar{x}_2$, $x_1$, $\bar{x}_1$, $x_0$, $\bar{x}_0$. On the front surface 32 of front cover 30 are printed, in an array to the left of the truth-table window column 36, the binary equivalents of the adjacent pull tab 81 decimal numbers. At the top of the columns of this array are printed the variable labels (left to right): $x_3$, $x_2$, $x_1$, $x_0$.

In the preferred embodiment, there are sixteen slides 80 and sixteen corresponding truth-table windows 38. The K-map grid 40 comprises four rows and four columns of windows 42. There are eight output variable slots 68. There are four horizontal operating positions of each slide 80. There are four display plate indicia 94. The preferred embodiment may be used to solve problems having up to four variables. However, this invention may be applicable to problems having more than four variables by increasing the number of slides and the corresponding orders of the truth-table and K-map.

METHOD OF OPERATION

As discussed, a four-variable logic design slide rule 20 of my invention has sixteen slides 80. Each represents a number or logic term ranging from 0 to 15 (in decimal notation) or from 0000 to 1111 (in binary notation). By moving these slides from side to side one can alter the front beam indicia 86 visible through the truth-table windows 38 in the front cover plate 30 and the display plate indicia 94 visible through the corresponding K-map windows 42. The design of the slide rule 20, as discussed above, ensures that the truth-table display 36 and its corresponding K-map display 40 are consistent with each other.

There are four possible entry indicia, for each truth-table or K-map display window. They are "0", "1", "x" or "#". The first three indicate the logic states of "false", "true" and "do not care", respectively, and the last entry indicates that this particular number or logic term is being used in the minimization process by the grouping of adjacent K-map elements.

The rear cover plate 60 of a four-variable logic design slide rule 20 has eight output variable slot apertures 68. Every slot 68 represents one of eight possible output variables (reading left to right): $x_3$, $\bar{x}_3$, $x_2$, $\bar{x}_2$, $x_1$, $\bar{x}_1$, $x_0$, $\bar{x}_0$. The key design concept of the slide rule is that whenever a slide 80 is moved to the "#" position, it will correctly eliminate the unwanted output variables by displaying an "x" rear beam indicium 87 at each of their corresponding slots 68. Therefore, by correctly selecting a group of 1, 2, 4, or 8 adjacent K-map element(s), the minimized logic term corresponding to the group can be read directly from the back 64 of the slide rule by searching for the slot 68 with no "x" rear beam indicia 87 visible. The design of the logic design slide rule allows the user to reset the K-map after each grouping and to perform further groupings until the truth-table is completely reduced to its minimum form.

The method of operation of the slide rule 20 of this invention will be illustrated by describing the solution to a sample problem having the following truth-table.

| | | |
|---|---|---|
| 0 | 0000 | 0 |
| 1 | 0001 | 0 |
| 2 | 0010 | 1 |
| 3 | 0011 | 1 |
| 4 | 0100 | 0 |
| 5 | 0101 | 0 |
| 6 | 0110 | 1 |
| 7 | 0111 | 1 |
| 8 | 1000 | 0 |
| 9 | 1001 | 0 |
| 10 | 1010 | 1 |
| 11 | 1011 | 1 |
| 12 | 1100 | 0 |
| 13 | 1101 | 0 |
| 14 | 1110 | 1 |
| 15 | 1111 | 1 |

(1) To initialize the slide rule, pull every slide 80 leftward to its outermost position. This will result in the display of the "0" entry at every truth-table 36 and K-map 40 window.

Figure 5:
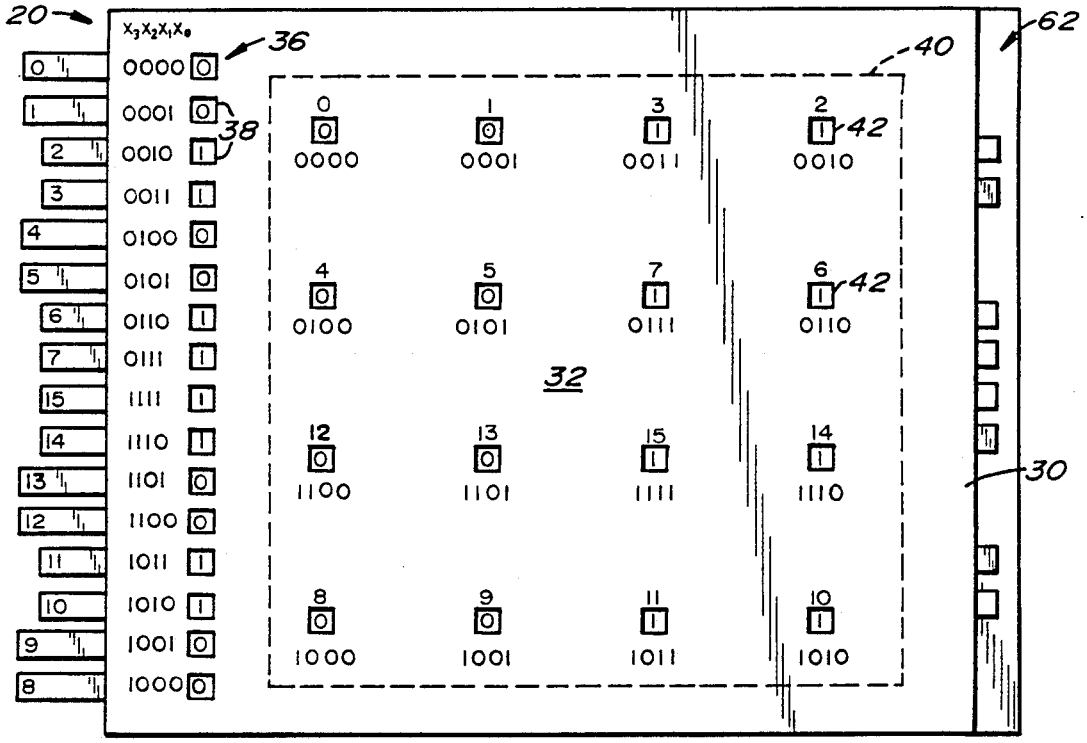
FIG. 5 is a front view of the slide rule in one position showing indicia.

(2) The next step is to implement the problem truth-table by moving the slides 80 toward the right of the device 20 until the appropriate entry will be displayed at each truth-table and K-map display window. It is necessary to exercise caution in that the order of the lower half of the truth table is reversed on the left ends of pull tabs 81 and the truth table column 36. The view of the front cover 30 resulting from this step is illustrated in FIG. 5 for the sample problem.

Figure 6:
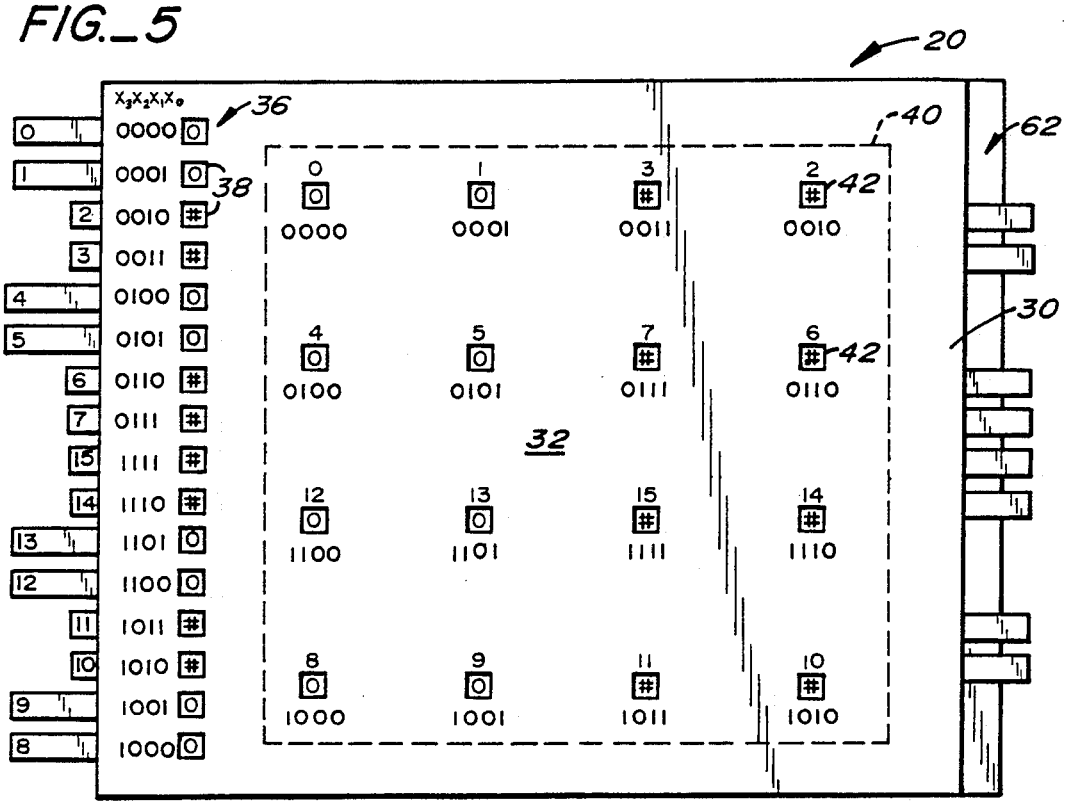
FIG. 6 is a front view of the slide rule in a second position showing indicia.

(3) Next, select adjacent elements for grouping according to the K-map grouping techniques. Push the slides 80 corresponding to the selected elements (in this example, slides 2, 3, 6, 7, 15, 14, 11 and 10) rightward to their rightmost positions. The entry "#" should be shown at the corresponding truth-table and K-map display windows 38, 42 after the slides are moved. The result is shown in FIG. 6.

Figure 7:
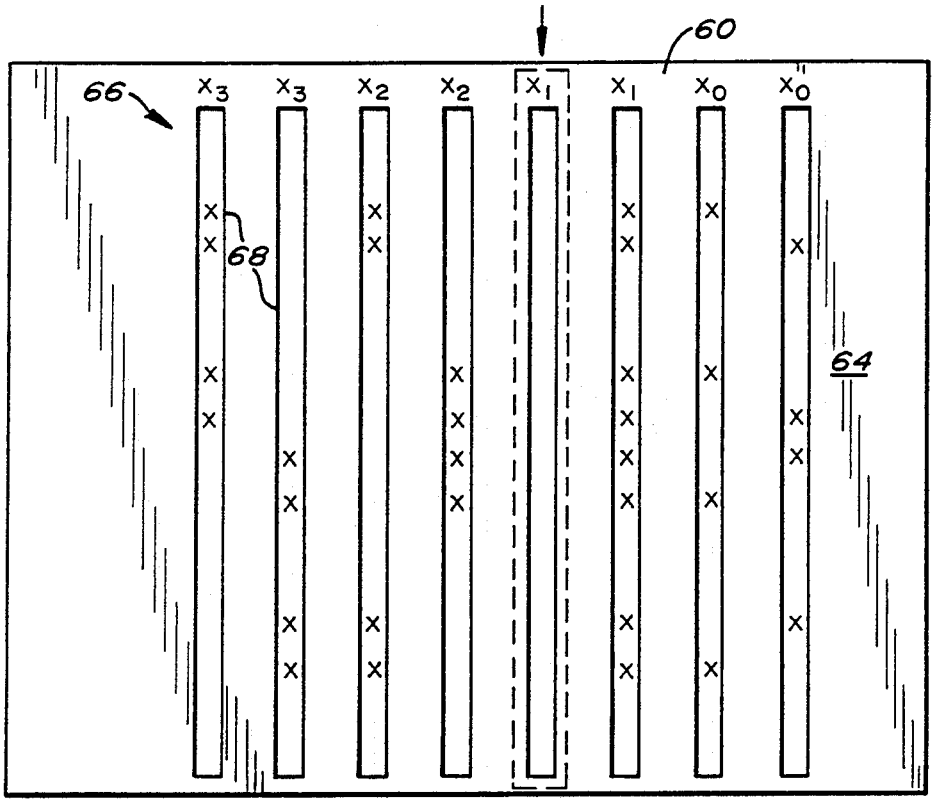
FIG. 7 is a rear view of the slide rule in the second position showing indicia.

(4) After all the grouping elements are selected and the corresponding slides are moved, turn the slide rule 20 over and observe the minimized logic term for this particular grouping through the output variable slots 68 in the rear cover 60. This minimized logic term contains only output variable(s) whose corresponding display slot 68 shows no "x" marks at all. Write the results down, which, as shown in FIG. 7, is output variable "$x_1$" for the example. Note that pull tabs 81 have no indicia on their observe sides. They are omitted in FIG. 7.

Figure 8:
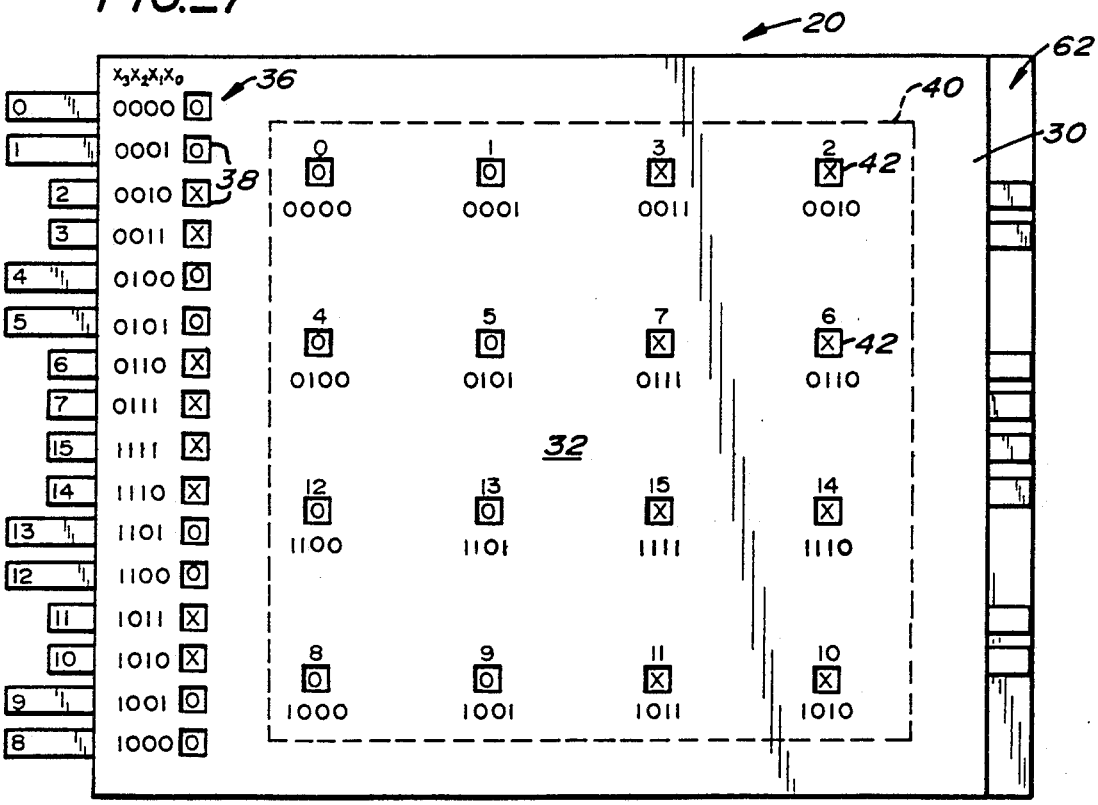
FIG. 8 is a front view of the slide rule in a third position showing indicia.

(5) Next, push the slides for the previous grouping leftward from the right until they are flush with the right hand edge of the logic design slide rule 20. In the preferred embodiment shown, the rear cover plate 60 protrudes slightly rightward to assist in this function, as seen in FIG. 8 where a portion of the front surface 62 of the rear cover 60 is visible. This will ensure that all elements that have been grouped before will be at the "x" (do not care) logic state.

(6) Check for completion by observing the resulting K-map 40 on the front cover 30. If all the entries are either "0" or "x", the minimization is completed, as is the case with the example shown solved in FIG. 8. If not, go back and repeat steps (3) to (6).

While the above provides a full and complete disclosure of the preferred embodiments of this invention, various modifications, alternate constructions, and equivalents may be employed without departing from the true spirit and scope of the invention. For example, the output variable slots 68 could easily be columns of windows comparable to the truth-table windows 38. The selection of display indicia could be changed. For example, for clarity, "#" may be replaced with a solid black square. The slides 80 could be lengthened so that the rear beams indicia 87 and the output variable slots 68 could be moved to the front, whereby the device could be operated without having to be overturned. Therefore, the above description and illustrations should not be construed as limiting the scope of the invention which is defined by the appended claims.

I claim:

1. A slide rule for displaying indicia including:

front and rear planar covers spaced apart from each other and having means for viewing indicia;

a plurality of slides having front and rear slide beam surfaces, the slides provided in a space between the covers so as to be slideably moveable with respect to the covers; and a plurality of indicia display plates attached to the front beam surfaces of the slides, at least one plate to a slide, the plates sandwiched between the front beam surfaces of the slides and the front cover.

2. The slide rule of claim 1, further including:

a first type of indicia provided on the display plates;

a second type of indicia provided on at least one of said surfaces of the slides; and wherein the viewing means includes aperture windows in at least one of said covers.

3. The slide rule of claim 2 wherein:

there are said second type of indicia provided on the front and rear beam surfaces; and there are aperture windows in the front and rear covers.

4. The apparatus of claim 3 further including:

spacing lips depending from the slides to separate slides from each other; and posts provided in the space between the covers which engage the spacing lips at alternate positions of the slides to prevent the slides from moving beyond predetermined slide positions and which posts form channels, in which channels the slides may be moved back and forth.

5. The apparatus of claim 4 wherein:

the front cover aperture windows comprise a column of first windows and a plurality of rows of second windows forming a grid and the rear cover aperture windows comprise a set of vertical slots or displaying variable output data.

6. The apparatus of claim 5 wherein:

the slides are arranged in four groups of four slides per group and the display plates are arranged so that all of the first indicia in any one group are aligned in a horizontal row.

7. The apparatus of claim 6 wherein:

each horizontal row of the first type of indicia underlies one horizontal row of said second windows from the grid.

8. The apparatus of claim 7 further including:

pull tabs on ends of the slides and extending out from the space between the covers for moving the slides back and forth.

9. The apparatus of claim 8 further including:

a third type of indicia printed on the covers for identifying the first windows, the second windows and the vertical slots.

10. A slide rule for displaying indicia including:

front and rear planar covers spaced apart from each other and having a first type of indicia provided thereon;

a plurality of slides;

posts provided in a space between the covers spacing the covers apart from each other and forming channels for the slides;

beams defining the slides having front and rear slide beam surfaces with at least one beam surface bearing a second type of indicia provided thereon, the slides held between the covers by the posts and slideably moveable with respect to the covers by within the channels;

a plurality of display plates having a third type of indicia provided thereon and attached to the front surfaces of the beams with at least one plate to a slide, the plates sandwiched between the front surfaces of the slide beams and the front cover; and aperture windows in at least one of said covers for viewing the second or third types indicia when the slides are moved so as to bring the indicia directly under the aperture windows.

11. The apparatus of claim 10 wherein:

the apertures form a column of first windows, a plurality of rows of second windows forming a grid, and a set of vertical slots for displaying variable output data.

12. The apparatus of claim 11 wherein:

the slides are arranged in four groups of four slides per group and the display plates are arranged so that all of the third type of indicia in any group are aligned in a horizontal row.

13. The apparatus of claim 12 wherein:

each horizontal row of the third type of indicia underlies one horizontal row of said second windows from the grid.

* * * * *